US011479838B2

(12) United States Patent
Skubich et al.

(10) Patent No.: US 11,479,838 B2
(45) Date of Patent: Oct. 25, 2022

(54) MANUFACTURING PROCESS FOR OBTAINING HIGH STRENGTH SOLID EXTRUDED PRODUCTS MADE FROM 6XXX ALUMINIUM ALLOYS FOR TOWING EYE

(71) Applicant: CONSTELLIUM SINGEN GMBH, Singen (DE)

(72) Inventors: Alexis Skubich, Zurich (CH); Martin Jarrett, Little Bourton (GB); Fabian Pfaender, Tuttlingen (DE); Ivan Grbavac, Stockach (DE); Matthias Kutscher, Constance (DE); Frank Gensty, Ostrach (DE); Roland Tirard-Collet, Voreppe (FR)

(73) Assignee: CONSTELLIUM SINGEN GmbH, Singen (DE)

( * ) Notice: Subject to any disclaimer, the term of this patent is extended or adjusted under 35 U.S.C. 154(b) by 390 days.

(21) Appl. No.: 15/736,173

(22) PCT Filed: Jun. 14, 2016

(86) PCT No.: PCT/EP2016/063656
§ 371 (c)(1),
(2) Date: Dec. 13, 2017

(87) PCT Pub. No.: WO2016/202810
PCT Pub. Date: Dec. 22, 2016

(65) Prior Publication Data

US 2018/0171449 A1 Jun. 21, 2018

(30) Foreign Application Priority Data

Jun. 15, 2015 (EP) ..... 15172208

(51) Int. Cl.
*C22C 21/08* (2006.01)
*C22F 1/05* (2006.01)
(Continued)

(52) U.S. Cl.
CPC ..... *C22F 1/05* (2013.01); *C22C 21/02* (2013.01); *C22C 21/06* (2013.01); *C22C 21/08* (2013.01);
(Continued)

(58) Field of Classification Search
None
See application file for complete search history.

(56) References Cited

U.S. PATENT DOCUMENTS 5,027,634 A † 7/1991 Visser
5,503,690 A * 4/1996 Wade ..... C22F 1/05 148/439
(Continued)

FOREIGN PATENT DOCUMENTS

EP 0302623 B1 1/1992
EP 1155156 B1 11/2001
(Continued)

OTHER PUBLICATIONS

Saha, Pradip K., Aluminum Extrusion Technology, ASM International, Mar. 2000, pp. 50-51.*
(Continued)

*Primary Examiner* — George Wyszomierski
(74) *Attorney, Agent, or Firm* — McBee Moore & Vanik IP, LLC

(57) ABSTRACT

The invention relates to a manufacturing process for obtaining 6xxx-series aluminium alloy solid extruded products, comprising Si: 0.3-1.7 wt. %; Mg: 0.1-1.4 wt. %, Cu: 0.1-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % the rest being aluminium, having particularly high mechanical properties, typically an ultimate tensile strength higher than 400 MPa, preferably
(Continued)

430 MPa, and more preferably 450 MPa without the need for a post-extrusion solution heat treatment operation. The invention also concerns a manufacturing process for obtaining a bumper system in which is integrated a towing eye, said towing eye being made with said high mechanical properties aluminium alloys.

20 Claims, 5 Drawing Sheets

(51) Int. Cl.

| | |
|---|---|
| ***C22C 21/02*** | (2006.01) |
| ***C22F 1/04*** | (2006.01) |
| ***C22C 21/12*** | (2006.01) |
| ***C22C 21/14*** | (2006.01) |
| ***C22F 1/047*** | (2006.01) |
| ***C22F 1/043*** | (2006.01) |
| ***C22F 1/057*** | (2006.01) |
| ***C22C 21/18*** | (2006.01) |
| ***C22C 21/10*** | (2006.01) |
| ***C22C 21/16*** | (2006.01) |
| ***C22C 21/06*** | (2006.01) |
| ***C22F 1/053*** | (2006.01) |
| *B21C 23/00* | (2006.01) |
| *B21C 23/14* | (2006.01) |

(52) U.S. Cl.

CPC ..... *C22C 21/10* (2013.01); *C22C 21/12* (2013.01); *C22C 21/14* (2013.01); *C22C 21/16* (2013.01); *C22C 21/18* (2013.01); *C22F 1/04* (2013.01); *C22F 1/043* (2013.01); *C22F 1/047* (2013.01); *C22F 1/053* (2013.01); *C22F 1/057* (2013.01); *B21C 23/002* (2013.01); *B21C 23/14* (2013.01)

(56) References Cited

U.S. PATENT DOCUMENTS

| | | | | |
|---|---|---|---|---|
| 5,571,347 | A * | 11/1996 | Bergsma | C22C 21/08 148/415 |
| 2004/0084119 | A1 | 5/2004 | Sano et al. | |
| 2006/0071488 | A1* | 4/2006 | Guinehut | B60R 19/34 293/133 |
| 2011/0155291 | A1 | 6/2011 | Sano et al. | |
| 2012/0156089 | A1* | 6/2012 | Gejima | C22C 21/08 420/532 |
| 2014/0290809 | A1* | 10/2014 | Hori | C22C 21/08 148/550 |
| 2016/0304994 | A1* | 10/2016 | Skubich | B21C 23/002 |

FOREIGN PATENT DOCUMENTS

| | | | |
|---|---|---|---|
| JP | H04341546 | A | 11/1992 |
| JP | H07 3409 | A | 1/1995 |
| JP | 2007177308 | A | 7/2007 |
| WO | 0030780 | A1 | 6/2000 |
| WO | 2011122958 | A1 | 10/2011 |
| WO | 2013162374 | A1 | 10/2013 |

OTHER PUBLICATIONS

Van Geertruyden, W. H. et al., "Evolution of Surface Recrystallization during Indirect Extrusion of 6xxx Aluminum Alloys", Metallurgical and Materials Transactions A, vol. 36A, Apr. 2005, pp. 1049-1056.*

Reiso Oddvin, "The effect of Billet Preheating Practice on Extrudability of AlMgSi Alloys" Proceedings of Fourth International Aluminium Extrusion Technology Seminar—vol. II Interactions Die Technology Die lines, Surface tearing and Metal Flow Process technology Marketing Value Added activities Conform Al—Li alloys, pp. 287-295, Apr. 1988.

International Search Report of International Patent Application No. PCT/EP2016/063656 dated Aug. 26, 2016.

H. Westengen, L. Auran, and O. Reiso, "Effect of minor additions of transition elements on the recrystallization of some commercial aluminum alloys," Aluminum, (1981), vol. 57, No. 12: 797-803.

J. Røyset, et al., "An Investigation of Sc Addition on the Extrudability, Recrystallisation Resistance and Mechanical Properties of a 6082- and a 7108-Alloy," Materials Forum, (2004), vol. 28, 246-251.

Registration Record Series Teal Sheets, "International Alloy Designations and Chemical Composition Limits for Wrought Aluminum and Wrought Aluminum Alloys," The Aluminum Association, (Revised 2009), 1-28.

Jostein Røyset, et al., "Al—Mg—Si Alloys with Improved Crush Properties," The Ninth International Aluminum Extrusion Technology Seminar, (2008).

Oddvin Reiso, "The Effect of Cooling Rate After Homogenization and Billet Preheating Practice on Extrudability and Section Properties Part 1: Extrudability and Mechanical Properties," Proceedings of International Aluminium Extrusion Technology Seminar, vol. 1. Aluminium Association Inc, & Aluminium Extruders Council, (1997.).

W. Strehmel, "Taper Quenchin—Energieverschwendung?" Aluminium-Dusseldorf, (2006), vol. 82, No. 10: 926-934.

Jostein Røyset, et al., "Almech—A Computer Program for Alloy Selection and Extrusion Process Improvement," Proc. 8th International Aluminum Extrusion Technology Seminar, (2004), 81-91.

"Brazing and Soldering," ASM Specialty Handbook, Aluminum and Aluminum Alloys, (1993), 420.

Jostein Røyset, et al., "Effect of Alloy Chemistry and Process Parameters on the Extrudability and Recrystallization Resistance of 6082 Aluminum Alloy," Hydro Aluminum R&D and Technology, (2008).

Oddvin Reiso, "Extrusion of AlMgSi Alloys," Proceedings of the 9th International Conference on Aluminum Alloys, (2004), vol. 32, 32-46.

Bin-Lung Ou and Chin-Hui Shen, "Impact of pre-aging on the tensile and bending properties of AA 6061," Scandinavian Journal of Metallurgy, (2005), vol. 34, 318-325.

"International Alloy Designations and Chemical Composition Limits for Wrought Aluminum and Wrought Aluminum Alloys," The Aluminum Associations, pp. 1-37, Feb. 2009.†

"Tempers for Aluminum and Aluminum Alloy Products," The Aluminum Association, pp. 1-37, Feb. 2009.†

Sano,"New Hollow Extrusion of High Strength Al—Mg—Si—Cu alloy," Seventh International Aluminum Extrusion Technology Seminar, pp. 167-175, May 16-19, 2000.†

Jenista, "Taper Quenching, A Case Study," Seventh International Aluminum Extrusion Technology Seminar, pp. 83-87, May 16-19, 2000.†

* cited by examiner
† cited by third party a b

MANUFACTURING PROCESS FOR OBTAINING HIGH STRENGTH SOLID EXTRUDED PRODUCTS MADE FROM 6XXX ALUMINIUM ALLOYS FOR TOWING EYE

CROSS-REFERENCE TO RELATED APPLICATIONS

This application is a National Stage entry of International Application No. PCT/EP2016/063656, filed 14 Jun. 2016, which claims priority to European Patent Application No. 15172208.9, filed 15 Jun. 2015.

BACKGROUND

Field

The invention relates to a manufacturing process for obtaining 6xxx-series aluminium alloy solid extruded products having particularly high mechanical properties, typically an ultimate tensile strength higher than 400 MPa, preferably 430 MPa, and more preferably 450 MPa without the need for a post-extrusion solution heat treatment operation. The invention also concerns a manufacturing process for obtaining a bumper system in which is integrated a towing eye, said towing eye being made with said high mechanical properties aluminium alloys.

Unless otherwise stated, all information concerning the chemical composition of the alloys is expressed as a percentage by weight based on the total weight of the alloy. "6xxx aluminium alloy" or "6xxx alloy" designate an aluminium alloy having magnesium and silicon as major alloying elements. "AA6xxx-series aluminium alloy" designates any 6xxx aluminium alloy listed in "International Alloy Designations and Chemical Composition Limits for Wrought Aluminum and Wrought Aluminum Alloys" published by The Aluminum Association, Inc. Unless otherwise stated, the definitions of metallurgical tempers listed in the European standard EN 515 will apply. Static tensile mechanical characteristics, in other words, the ultimate tensile strength Rm (or UTS), the tensile yield strength at 0.2% plastic elongation $R_{p0,2}$ (or TYS), and elongation A % (or E %), are determined by a tensile test according to NF EN ISO 6892-1.

The thickness of solid extruded products is defined according to standard EN 2066:2001: the cross-section is divided into elementary rectangles of dimensions A and B; A always being the largest dimension of the elementary rectangle and B being regarded as the thickness of the elementary rectangle. A is considered as the width of the extrusion. Solid extruded products are opposed to hollow extruded products.

A motor vehicle after an accident is perhaps no longer independently drivable. The motor vehicle must be then towable. Such condition also exists in case of lack of fuel or loss of on-board electronics. Threaded towing eyes are state of the art to insure towing. According to the European directives 77/389/EEC, all motor vehicles must have a special towing-device fitted at the front, to which a connecting part, such as a towing-bar or tow-rope, may be fitted. The towing device or towing system is obtained by an assembly of a towing eye and a ring. The towing eye consists in a towing nut, integrated to the chassis of the towed vehicle. The towing nut provides a safe point of attachment. The towing nut is usually threaded and makes it called a "towing eye". To permit the attachment of the tow bar, a hook or a ring is screwed in the towing eye, as represented in FIGS. 6 and 7. The towing eye is connected usually directly with motor vehicle structural components, for example a bumper, a crash box, or directly with the basic body. In EP06405167, the invention relates to a bumper system containing a bumper running in the transverse direction of a vehicle and at least one connecting element on the bumper for the purpose of mounting it onto a vehicle, in particular a private car, whereby the connecting element is a multi-chamber extruded metal section with its longitudinal axis (x) running in the longitudinal direction of the vehicle, and the connecting element is in the form of a safety element which under impact absorbs energy of impact by compression. The invention is characterized in that attachment means for connecting to a towing facility is provided in one of the hollow chambers of the connecting element.

The towing system is expected to sustain a given load which is mostly proportional to the total weight of the motor vehicle. It exists some constraints for the towing system to sustain a maximum load in particular, in the case of a transport on a tow truck or a ferry. Also towing eye must permit the raising of a motor vehicle by means of a crane.

In most cases, towing eyes are made in aluminium, typically from AA6082 solid extrusion which present an ultimate tensile strength of 300 to 320 MPa. But with the trend to produce bigger motor vehicles such as SUVs, higher forces when towing arise, increasing up to several thousand newton. There is a need for materials exhibiting an ultimate yield strength higher than 400 MPa, preferably 430 MPa and more preferably 450 MPa. Steel is a conventional material that can be selected as it presents for certain grade such properties. However, steel presents major disadvantages, such as its weight and its corrosion sensitivity. Thus, low cost solid aluminum extrusion, typically with a thickness higher than 10 mm, more preferably 20 mm to manufacture towing eyes with an ultimate yield strength higher than 400 MPa, preferably 430 MPa and more preferably 450 MPa are needed. Compared to steel materials, aluminium at iso-properties has the advantages to be lighter (approximately three times lighter) and doesn't need to be coated to insure corrosion protection.

AA6082 solid extrusions are typically used for towing system due to their high mechanical strength in T6 temper; in T6 temper AA6082 solid extrusions present an ultimate tensile strength of 300 to 320 MPa. Such 6082 thick solid extruded products and other similar high strength 6xxx aluminium alloys extruded products (AA6182, AA6056, AA6061, . . . ) are currently produced by a manufacturing process, such as the following one, which comprises:

a) homogenizing a cast billet by holding the billet several hours, typically between 3 and 10 hours, at a temperature between 0° C. and 75° C. lower than solidus—which is near 575° C.-595° C. for such alloy—and cooling the homogenized cast billet to room temperature;
b) heating the homogenised cast billet to a temperature 20° C. to 150° C. lower than solidus temperature;
c) extruding the said billet through a die to form at least one solid extruded product with an 1*s* extrusion speed such that the surface temperature of the extrudate reaches the solid solution temperature, which is higher than 520° C. but lower than solidus, commonly ranging from 530° C. to 560° C., in order to avoid incipient melting due to non-equilibrium melting of precipitates formed from solute elements (e.g. Mg2Si, Al2Cu) in profile hot-spots but still allow to dissolve part of the aforementioned phases that will later contribute to hardening the alloy by re-precipitation during ageing;

d) quenching the extruded product with an intense cooling device down to room temperature;

e) stretching, typically between 0.5% and 5%, the extruded product to obtain a straight stress-relieved profile;

f) ageing the extruded product by a one- or multiple-step heat treatment at temperatures ranging from 150 to 200° C. for a prescribed time of period, between 1 and 100 hours, depending on the targeted property(ies), for example the highest ultimate strength which can be obtained by this way.

For ultra-high strength requirements, alloying elements such as Si, Mg and Cu should be added to form precipitated hardening phases but the resulting alloy compositions are significantly less easy to extrude, because of the limited capability to dissolve the precipitated phases resulting from the solute additions using conventional billet heating and press solutionising and quenching practices as described above (steps c) and d)). Indeed, the addition of alloying elements results in a significant decrease in solidus to solvus range, which becomes a narrow "window". Practically, the solidus to solvus window is less than 10° C.-20° C. for alloys with high $Mg_2Si$ content, typically comprised between 1.2 and 1.6% and Si excess up to 0.7 wt. %, especially if Si excess is between 0.2 wt. % and 0.7 wt. %. Si excess is evaluated by Si—Mg/1.73-0.3*(Fe+Mn), where Si, Mg, Fe and Mn contents are in wt. %. This solidus to solvus window is particularly narrow (less than approx. 10° C.) if Cu content lies between 0.4 and 0.8 wt. %. Such a narrow solidus to solvus window compromises extrudability through premature hot-tearing: if the exit temperature is too high, the material suffers hot cracks on exit from the die and if the exit temperature is too low, the dissolution of the precipitates resulting from the solute additions does not occur, which is necessary to provide the required strength after natural or artificial ageing.

In this latter case, the application of a separate solution heat treatment should be applied after extrusion and before ageing. A separate post-extrusion solution heat treatment is therefore essential for obtaining hard 6xxx aluminium alloy extrusions for the reasons described above. Typically this involves the insertion of additional process steps between steps e)—or d) in the case where e) were not carried out—and f):

e') solution heat treating the extruded product for a defined period of time e.g. 15 to 60 minutes for a 6xxx alloy at a temperature higher than the extrusion exit temperature (typically 530-560° C.), as there is this time no temperature-gradients in the profile that could lead to incipient melting in hot-spots.

e") quenching the solution heat treated extruded product down to room temperature.

e"') optionally stretching, typically between 0.5% and 5%, the extruded product to obtain a straight stress-relieved profile A separate post-extrusion solution heat treatment is thus applied to the extruded product, which increases the dissolution of phases constituted by precipitation of solute elements and present in the as-quenched temper. The extrudate is then aged (step f)) and can raise a strength level higher than if it is not post-extrusion solution heat treated. However, the gain is less than expected, because the structure of the extrudate resulting from this separate post-extrusion solution heat treatment is generally partially recrystallized, which lead to a more or less significant drop in mechanical properties, depending among other parameters on the chemistry of the alloy.

For high extrusion ratio, typically 30 to 40, extrusions with this processing route, have a partially recrystallized structure at least in most part of their cross-section, especially at the extruded product surface, such that their ultimate tensile strength cannot reach a maximum value higher than approximately 370 MPa in the case of copper-free 6xxx alloys and 380 MPa for copper containing 6xxx alloys.

For AA6xxx profile sections, this additional separate post-extrusion solution heat treatment step presents a number of major disadvantages, i.e. increased manufacturing costs, poor geometrical capability due to profile distortion and risk of recrystallization during the solution heat treatment that leads to a significant drop in mechanical properties.

JPH73409 describes a manufacturing process for obtaining extruded products made of an aluminum alloy, the composition of which is defined with broad content ranges such that it encompasses usual high strength aluminium alloys such as AA6082, AA6182, AA6061, AA6056, etc. This process consists in heat treating the billet 1-30 hr. at a temperature between 150° C. and 300° C. before the homogenization step (5 hours at soaking temperature 560° C.), the heating rate being below 300° C./hr before each stage and then cooling to room temperature with a cooling rate below 150° C./hr. According to this patent application, slightly higher ultimate tensile strengths can be obtained when carrying out this, which includes obligatorily a separate post-extrusion solution treatment operation. However, the ultimate tensile strengths thus obtained are lower than 390 MPa for copper-free alloys and 410 MPa for copper-containing alloys.

SUMMARY OF THE INVENTION

The applicant decided to develop a method for manufacturing ultra-high strength AA6xxx alloy solid extrusions, with a thickness higher than 10 mm, obtained with an acceptable extrusion speed in solid form and having an ultimate tensile strength higher than 400 MPa, without the need for an additional post-extrusion solution treatment operation.

A first object of the invention is a manufacturing process for obtaining a solid extrusion with a thickness higher than 10 mm, wherein said manufacturing process comprises following steps a) casting a billet of aluminum an alloy comprising Si: 0.3-1.7 wt. %; Mg: 0.1-1.4 wt. %, Cu: 0.1-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % the rest being aluminium.

b) homogenizing said billet;

c) heating the said homogenised cast billet;

d) extruding the said billet through a die to form a solid extrusion with a thickness higher than 10 mm;

e) quenching said solid extrusion down to room temperature;

f) optionally stretching the solid extrusion to obtain a plastic deformation typically between 0.5% and 5%;

g) ageing the quenched and optionally stretched solid extrusion without applying any separate post-extrusion solution heat treatment, wherein said ageing treatment is a one- or multiple-step heat treatment at a temperature between 150° C. and 200° C. for a prescribed period of time, defined to obtain the maximum ultimate strength characterised in that:

i) the heating step c) is a solution heat treatment wherein:
   c1) the cast and homogenized billet is heated to a temperature between Ts-15° C. and Ts, wherein Ts is the solidus temperature of the said aluminium alloy;
   c2) the billet is cooled until billet mean temperature reaches a value between 370° C. and 480° C. while ensuring billet surface never goes below a temperature substantially close to 370° C.

ii) the cooled billet is immediately extruded (step d), typically in a few ten seconds, such as 50 s, preferably less than 40 s after the end of step c2).

iii) said aged solid extrusion presents an ultimate tensile strength higher than 400 MPa, preferably higher than 430 MPa and more preferably 450 MPa Said solid extrusion obtained by the manufacturing process according to the invention can be used to manufacture a towing eye. Said towing eye is preferentially machined from a solid extrusion whose thickness is higher than 20 mm.

A second object of the invention is a towing eye manufacturing method which comprises carrying out the invention process to obtain a solid extrusion with a thickness higher than 10 mm, preferentially higher than 20 mm and machining into it a threaded hole into a given portion of said solid extrusion, said machining using any appropriate sequences such as for example cutting, drilling, turning, grinding, threading. Said solid extrusion with a thickness higher than 10 mm, preferentially higher than 20 mm is preferentially cut to a given length, drilled and threaded. Additional machining can be optionally considered according to the design, such as grinding, turning, cutting, drilling, threading.

In a preferred embodiment, the towing eye is integrated into a bumper in-line, i.e. the machining is performed during or after the shaping of the bumper. A solid extrusion is obtained according the process of the invention described above with a minimum thickness of 10 mm, preferentially 20 mm. It is sometimes preferred to have a solid extrusion section with a width at least equal or higher than the thickness, preferentially the width is 1 to 3 times the thickness.

A third object of the invention is a manufacturing method for obtaining a bumper with a towing eye, wherein the process according to the invention to obtain a solid extrusion with a thickness higher than 10 mm, preferentially 20 mm is carried out, the resulting aged solid extrusion is cut to a given length, said length being preferentially lower than 150 mm, said cut solid extrusion is positioned into a hollow extrusion section with at least one chamber, said hollow section having a length higher than 1 m, said solid extrusion is fixed to the hollow extrusion section by any appropriate method, such as crimping, screwing, bolting, bonding, welding, a hole is drilled and threaded in the part of the hollow section and in said solid extrusion to create the towing eye.

Among other objects of the invention there is a solid extrusion with a thickness higher than 10 mm obtainable by a process according to the invention, characterized in that it is made of an aluminum an alloy comprising Si: 0.3-1.7 wt. %; Mg: 0.1-1.4 wt. %, Cu: 0.1-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % each, the rest being aluminium and presents an ultimate tensile strength higher than 400 MPa, preferably higher than 430 MPa and more preferably 450 MPa.

Yet another object of the invention is a towing system made of a towing eye obtainable according to the method of the invention and a ring.

Yet another object of the invention is a bumper with a towing eye, obtainable according to the method of the invention.

Yet another object of the invention is a motor vehicle with a towing eye, wherein said towing eye is obtained according to a method of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 *a*) corresponds to the grain structure observed in optical metallography obtained with a conventional route with a separated heat treatment after extrusion and FIG. 8 *b*) corresponds to the grain structure obtained with the process according to the invention. The grain structure obtained by the invention presents a homogeneous structure across the thickness of the extrusion with no PCG while the product obtained with the conventional route presents a 1 mm thick PCG layer. The details of the process routes are described in example 1.

DETAILED DESCRIPTION OF A PREFERRED EMBODIMENT

Figure 1A:
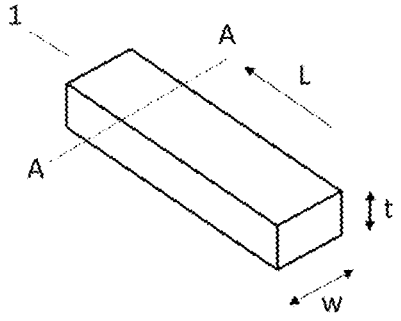
FIG. 1*a* is a perspective view of a solid extrusion (1) obtained according to the invention and FIG. 1*b* corresponds to the cross section perpendicular to the extrusion direction. It represents a bar, whose thickness is referenced as a t and the width as a w.
Figure 1B:
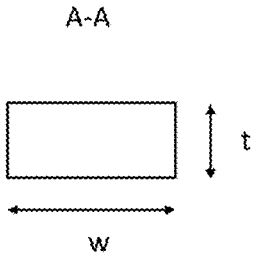
Figure 2A:
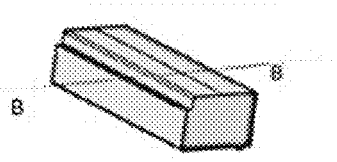
FIG. 2*a* is a perspective view of a solid extrusion cut to length (2) and FIG. 2*b* corresponds to two different cross section B-B and a top view of said solid extrusion. The solid extrusion obtained according to this example has a thickness t' of 21.7 mm and a width w' of 32.3 mm. The ratio between w' and t' is 1.5. The solid extrusion is cut to a length L' of 86 mm.
Figure 2B:
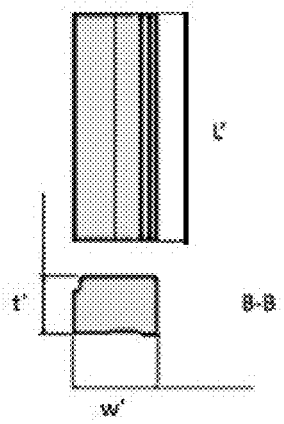

The process according to the invention consists in replacing the conventional heating of billets before extrusion with an over-heating and quenching them from the very high temperature of the solution heat treatment to the extrusion temperature. According to the present invention, following steps—extruding, press-quenching and ageing to achieve the targeted property, in particular an ultra-high ultimate strength—do not necessarily comprise a separate post-extrusion solution heat treatment, because, as a result of steps c1) and c2), most part of the alloying elements which contribute to the formation of hardening particles are in solid solution in the lattice of the extrudate.

The present invention therefore provides a process to extrude a 6xxx alloys comprising and preferably consisting of Si: 0.3-1.7 wt. %; Mg: 0.1-1.4 wt. %, Cu: 0.1-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % the rest being aluminium, in a solid form with a thickness higher than 10 mm, without a separate solution heat treatment, and presenting superior mechanical properties with strength levels in excess of 400 MPa, hitherto not achieved through a conventional "press quenched" route. In addition, good extrudability is maintained because the limitation with extrusion speed due to premature speed cracking resulting from incipient melting is minimised due to a stronger level of solutionising of phases constituted by precipitation of solute elements prior to extrusion.

According to the invention, a billet is provided with a composition according to the invention. The cast billet is homogenised. The homogenisation treatment may follow a conventional route, i.e. between 3 and 10 hours at a temperature between 0*C and 75° C. lower than solidus. However, because of the solution heat treatment step c1) according to the invention, the homogenisation temperature is advantageously between 50° C. and 150° C., preferably between 80° C. and 150° C. lower than solidus, typically in the range 450°c.-500° C. The homogenised billet is then cooled down to room temperature.

The homogenised cast billet to be extruded is heated to a soaking temperature slightly below the solidus temperature Ts to be solution heat treated. According to the invention, the soaking temperature of the solution heat treatment is between Ts-15° C. and Ts. The billets are preferably heated in induction furnaces and hold at the soaking temperature during ten seconds to several minutes, typically 10 minutes, preferably between 80 and 120 seconds.

The billet is then cooled until its temperature reaches 370° C. to 480° C. while ensuring that the billet surface never goes below a temperature substantially close to 370° C. to avoid any precipitation of constituent particles, in particular coarse particles such as $Mg_2Si$ or Al2Cu. In other words, according to the invention, the mean temperature of the billet should be controlled, which implies that the cooling step has to follow an operating route, which should be pre-defined, for example by experimentation or through numerical simulation in which at least the billet geometry, the thermal conductivity of the alloy at different temperatures and the heat transfer coefficient associated with the cooling means are taken into account.

As soon as the billet temperature reaches a temperature between 370° C. to 480° C., the billet is introduced in the extrusion press and extruded through a die to form one or several solid or hollow extruded products or extrudates. The time delay between the end of cooling and the time at which the extrusion process starts is typically a few ten seconds, such as 50 s, preferably less than 40 s. The extrusion speed is controlled to have an extrudate surface exit temperature higher than 460° C. but lower than solidus temperature Ts. The exit temperature may be quite low, because, as a result of steps c1) and c2), alloying elements forming hardening precipitates are still in solution in the aluminium lattice. The exit temperature should be high enough to merely avoid precipitation. Practically, the targeted extrudate surface temperature is commonly ranging from 500° C. to 560° C., to have an extrusion speed compatible with a satisfying productivity.

The extruded product is then quenched at the exit of the extrusion press, i.e. in an area located between 500 mm and 5 m of the exit from the die. It is cooled down to room temperature with an intense cooling device, e.g. a device projecting sprayed water on the extrudates. The extrudates are then optionally stretched to obtain a plastic deformation typically between 0.5% and 5%, in order to have stress-relieved straight profiles.

The profiles are then aged without any prior post-extrusion solution heat treatment, by a one- or multiple-step heat treatment at temperature(s) ranging from 150 to 200° C. for a prescribed period of time, between 1 to 100 hours, to obtain the highest possible value of the ultimate strength of the alloy, possibly higher than the highest ultimate strength obtained by conventionally heating the billet and subjecting the extruded product to a post-extrusion solution heat treatment.

The process according to the invention allows obtaining press-quenched extruded products made from Cu-doped 6xxx alloys, which were until now very difficult, even almost impossible to extrude because of their very narrow solvus-solidus temperature window especially if copper content lies between 0.4 wt % and 0.8 wt %.

This process is particularly well suited to alloys with $Mg_2Si$ content comprised between 1.2 wt. % and 1.6 wt. %, Si excess up to 0.7%, particularly if comprised between 0.2 wt. % and 0.7 wt. % which gives a solvus to solidus temperature range approximately equal to or even lower than 10° C., and renders such alloy almost impossible to extrude with a conventional process.

Preferably the Cu content is between 0.4% and 0.8%.

Preferably 0.2 wt. %≤Si—(Mg/1.73)-(Fe+Mn)/3≤0.7 wt. % and the quantity of Mg2Si is in the range of 1.2 wt. % to 1.6 wt. %.

The maximum iron content is 0.5 wt. % and preferably 0.3 wt. %.

Other elements are at most 0.05 wt % each. Preferably other elements are at most 0.15 wt % total.

Preferably this alloy comprises at least two types or more of dispersoid element from the group of Mn, Zr or Cr. Typically with Zr between 0.05 and 0.25 wt. % and Mn between 0.15 and 1 wt %/o, the microstructures of the extruded products shows then a strong fibrous retention providing an additional strengthening contribution, considered important in meeting such high mechanical property values. Preferably, the grain structure is more than 90% unrecrystallized.

After having applied the process according to the invention to a composition comprised into disclosed range of composition comprising Si: 0.3-1.7 wt. %; Mg: 0.1-1.4 wt. %, Cu: 0.1-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % the rest being aluminium, the applicant was able to obtain solid extrusion having at T6 temper ultimate tensile strengths higher than 400 MPa, even higher than 430 MPa and even higher than 450 MPa.

Preferably, Si is between 0.8 wt % and 1.4 wt %.

Preferably, Mg is between 0.7 wt % and 1.2 wt %.

Preferably, Mn is between 0.40 wt % and 1.0 wt %.

Preferably, Zr is between 0.10 wt % and 0.20 wt %.

Preferably, Cr is between 0.05 wt % and 0.20 wt %.

Preferably, Zn is between 0.005 wt % and 0.10 wt %.

Preferably, Fe is between 0.10 wt % and 0.30 wt %/o.

Preferably said aged solid extrusion presents a tensile yield strength higher than 370 MPa, preferably higher than 400 MPa and more preferably higher than 420 MPa.

Thus, by applying the method according to the invention to a defined range composition, it has been demonstrated that mechanical properties in excess of 430 MPa can be achieved without the need for separate post-extrusion solution heat treatment. This provides a novel approach to the production of low cost ultra-high strength 6xxx alloy automotive structural components including towing system, where conventional aluminium extrusion production limits the mechanical properties (UTS) to a 320 MPa maximum.

The minimum solute content is defined, for a given manufacturing process, as the minimum wt. % of constituent elements permitting to guarantee a given strength level.

Under conventional manufacturing conditions, it takes into account the fact that solutionising step is generally partial: typically, 60-90% of constituent elements are in solid solution after quenching according to extrusion conditions, i.e. extrusion speed, extrusion exit temperature, etc. Under the conditions of the manufacturing process according to the invention, owing to the increase of the level of solutionising (typically 85-95%) and of its repeatability, the minimum wt. % of constituent elements to guarantee a given strength level can be strongly reduced vs. conventional manufacturing conditions without separate post-extrusion solution heat treatment and thereby the minimum solute content with the process according to the invention is lower.

By applying the method according to the invention to a defined composition range, a microstructure virtually exempt of any recrystallization is obtained and more specifically a microstructure exempt of any surface recrystallization, often referred to as peripheral coarse grain (PCG), which arises from static recrystallization which occurs when a dispersoid-containing (Mn, Cr, Zr . . . ) wrought aluminium alloy is held at high temperature namely above its recrystallization temperature (520° C. in the case of 6xxx within the defined composition range) which lies below the solvus (540-550° C.) in the case of 6xxx wrought aluminium alloys within the defined composition range. A near to absence of any recrystallisation accounts for homogeneous physico-chemical (typically corrosion resistance) and mechanical properties (formability, strength and ductility) throughout the section. Static recrystallization, or PCG, is typically observed during separate solutionising (soaking close or just below solvus for at least 15 min, typically 30 min or more) of 6xxx extrusions with compositions within the defined composition range. It has been demonstrated that by applying the method according to the invention to a defined composition range the thickness of the PCG can be lower than 1 mm, typically lower than 0.8 mm, preferably lower than 0.5 mm and more preferably lower than 0.2 mm.

The use of maximum fibre retention further provides the opportunity to substitute steel with aluminium solid extrusion obtained according to the invention. It permits at iso-design and iso-properties a gain of about three in terms of weight loss. It also avoids the need of surface protection, necessary on steel to avoid rust.

Said solid extrusion obtained by the manufacturing process according to the invention to presenting an ultimate tensile strength higher than 400 MPa, preferably higher than 430 MPa and more preferably 450 can be used to manufacture a towing eye. Said towing eye is preferentially machined from a solid extrusion whose thickness is higher than 10 mm, preferably higher than 20 mm. It is sometimes preferred to have a solid extrusion section with a width at least equal or higher than the thickness, preferentially the width is 1 to 3 times the thickness.

The towing eye manufacturing consists at least in machining a threaded hole into a given portion of said solid extrusion, obtained according to the manufacturing route described above. Said solid extrusion with a thickness higher than 10 mm and preferentially higher than 20 mm is preferentially cut to a given length, drilled and threaded. Additional machining can be optionally considered according to the design, such as grinding, turning, cutting, drilling, threading. The towing eye can be used either without any additional protection or with a surface protection to prevent corrosion risk. Said towing eye can constitute a towing system, in addition with a ring, said ring being designed to be screwed into the threaded hole of the towing eye. Said ring is preferentially used to attach a belt to the motor vehicle in case of towing or to insure the fixing of the motor vehicle during transport, possibly such transport being in a ferry or a truck.

Figure 3:
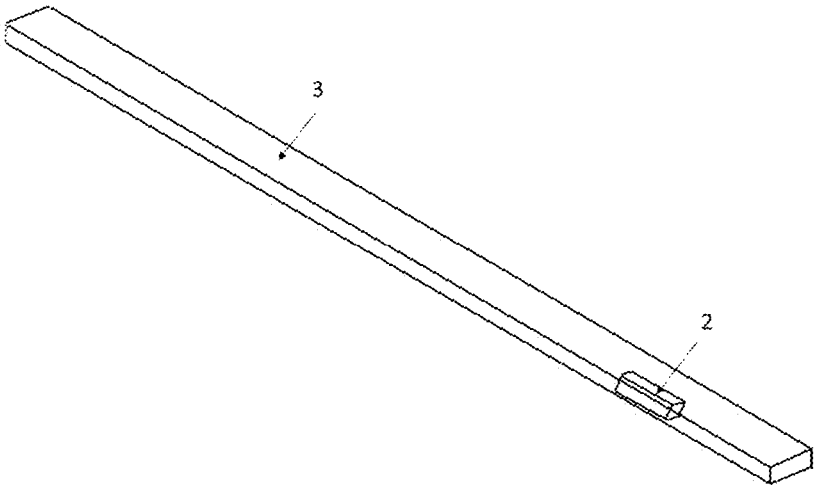
FIG. 3 is a perspective view of the straight hollow section with one chamber (3) with the insertion of the positioned cut solid extrusion (2), described in FIG. 2. Said hollow section is a precursor and will be shaped and machined to form a bumper.
Figure 4:
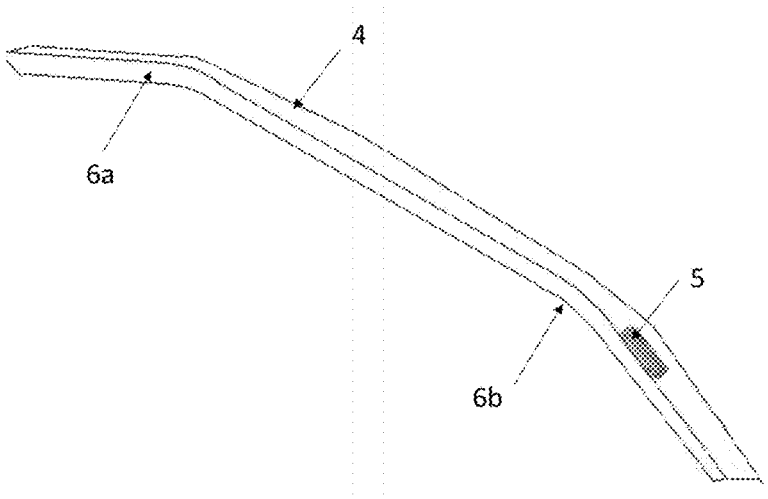
FIG. 4 is a perspective view of the machined bumper (4), produced in line with the inserted and fixed towing eye (5). The towing eye (5) is fixed to the bumper by the deformation of the walls of the hollow section precursor represented in FIG. 3. (6*a*) and (6*b*) corresponds to areas where the hollow section represented in FIG. 3 has been bent.
Figure 5:
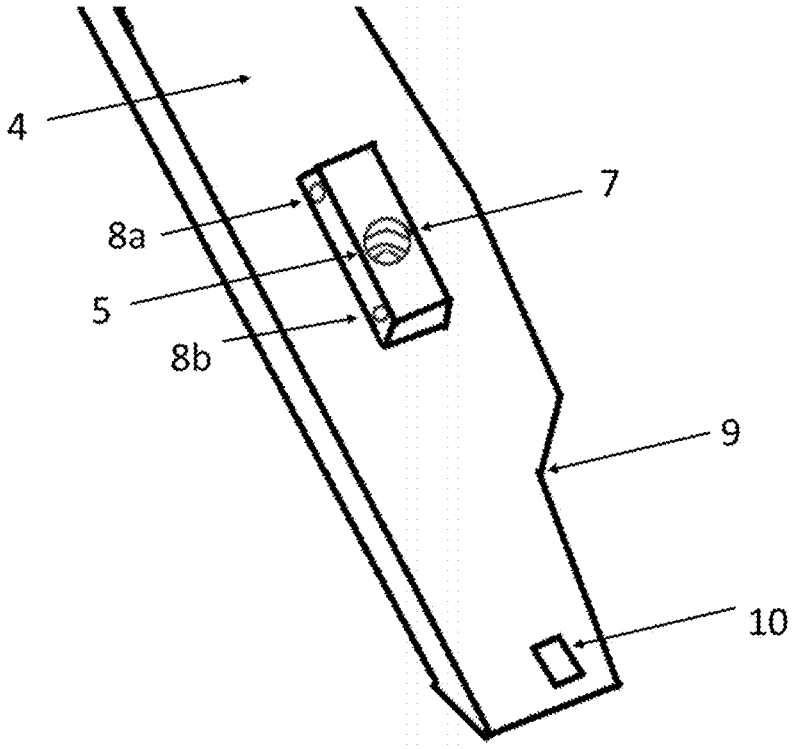
FIG. 5 is an enlargement of the part of the bumper (4) with the fixed towing eye (5) showing the threaded hole (7). Elements (8*a* and 8*b*) are holes machined in line, permitting to attach additional elements to the bumper (4). Elements (9) and (10) corresponds to machined areas in the bumper, done in line.
Figure 6:
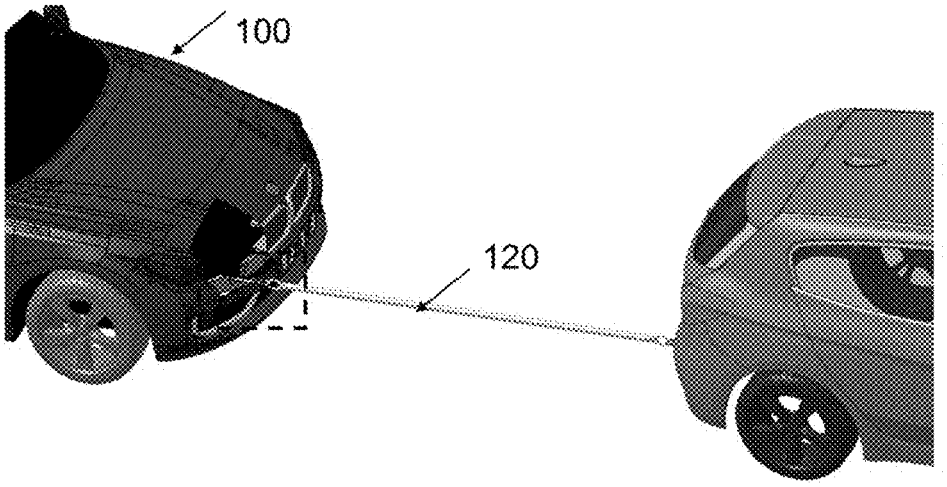
FIG. 6 is a perspective view of a towed vehicle (100) with a towing bar (120), using a towing system, whose principle is enlarged in FIG. 7.
Figure 7:
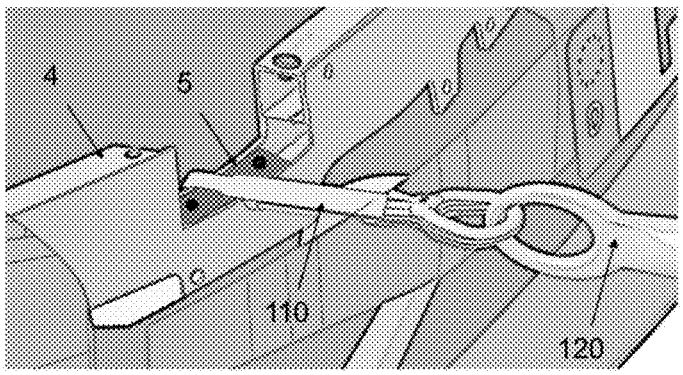
FIG. 7 is a perspective view of the towing system, constituted of a towing eye (5) integrated to into the bumper (4). A ring (110) is screwed in the threaded hole of the towing eye (5). The ring and the towing bar (120) are attached together to permit to tow the vehicle (100).

In a preferred embodiment, the towing eye is integrated into a bumper in-line, i.e. the machining is performed during the shaping of the bumper. This embodiment is described in FIG. 3 to 5. A solid extrusion is obtained according to the process of the invention described above with a minimum thickness of 10 mm, preferentially higher than 20 mm. It is sometimes preferred to have a solid extrusion section with a width at least equal or higher than the thickness, preferentially the width is 1 to 3 times the thickness Said solid extrusion is cut (2) to a given length, said length is preferentially lower than 150 mm. Said cut solid extrusion is positioned into a hollow extrusion section (3) with at least one chamber, said hollow section has preferentially a length higher than 1 m. Said solid extrusion has preferentially a section dimension permitting its insertion into the chamber of the hollow extrusion; the hollow extrusion being the precursor of the bumper.

said cut solid extrusion is fixed to the hollow extrusion section. In a preferred embodiment, the fixing is insured by crimping: crimping is obtained by deforming the walls of the hollow extrusion. Other appropriate methods can be considered to fix the solid extrusion as for example bolting, screwing, bonding, welding. These methods can also be combined.

Said fixed solid extrusion is machined to obtain a threaded hole. It consists in drilling and threading a hole in the part of the hollow section where said solid extrusion is fixed to create the towing eye. Additional machining can be optionally considered on the bumper and the towing eye. The invention consists in the towing eye obtained according to the manufacturing route of the invention. Another object of the invention is the bumper with a towing eye obtained according to the invention. Another object of the invention is the motor vehicle comprising a towing eye obtained according to the invention.

Example 1

A profile having an approximate rectangular section of 22 mm×32 mm (22 mm corresponds to its thickness) has been extruded by following two different process route: the conventional route (with a post solutionising heat treatment after extrusion) and the route according to the invention. The chemical composition is shown in Table 1. The solidus temperature for this composition is estimated at 588° C.

TABLE 1

| | Si | Fe | Cu | Mn | Mg | Cr | Zn | Ti | Zr |
|---|---|---|---|---|---|---|---|---|---|
| A | 0.8 | 0.2 | 0.7 | 0.53 | 0.8 | 0.003 | 0.013 | 0.043 | 0.13 |

For both routes, the cast billets were homogenized at a temperature 550° C. during 5 hours. The conventional route consisted in heating homogenized billet at a temperature ranging from 480° C. to 500° C. and then introducing into the container of the extrusion press to obtain an approximate rectangular section of 22 mm×32 mm. The extrusion speed was controlled such that the surface exit temperature was lower than solidus temperature. The extruded products were then quenched down to room temperature with a cooling device spraying water on the profiles exiting from the extrusion press. The profiles were then solution heat treated at 550° C. during 0.5 hours, water quenched, stretched 2% and aged at 170° C. during 8 h.

The process according to the invention consisted in solution heat treating homogenized cast billet, 100 seconds at a soaking temperature near 530° C. It was then cooled with a water cooling device giving a heat transfer flow of approximately 1 kW/m$^2$/° C. until billet surface temperature reached 440° C. Thirty-five seconds later, thanks to the high thermal conductivity of aluminium, the temperature is almost homogeneous in the billet and lower than 480° C. The billet was then introduced into the container of the extrusion press and extruded to obtain an approximate rectangular section of 22 mm×32 mm. The extrusion speed was controlled such that the surface exit temperature was higher than 530° C. and lower than solidus temperature. The extruded products were then quenched down to room temperature with a cooling device spraying water on the profiles exiting from the extrusion press. The profiles were then stretched 2% and aged at 170° C. during 8 h.

The mechanical properties obtained are listed in Table 2. It is observed that the invention permits to achieve similar mechanical properties to the conventional route with a more economical and shorter route.

TABLE 2

| | YS (MPa) | UTS (MPa) | Ag % | A % |
|---|---|---|---|---|
| Conventional route | 433 | 463 | 7.8 | 14.8 |
| Invention route | 419 | 452 | 7.9 | 14.7 |

Figure 8:
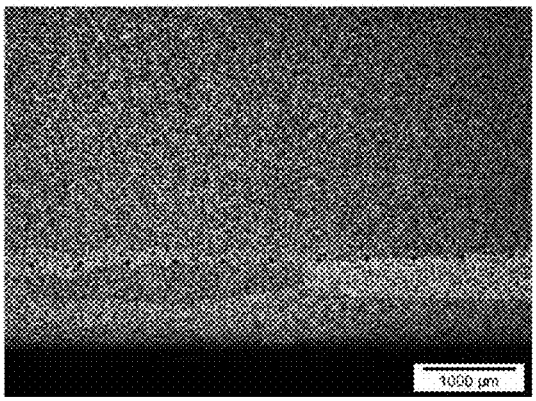
FIG. 8 represents grain structures after Barker etching in a cross section perpendicular to the extrusion direction of an extrusion profile 22 mm thick.
Figure 8:
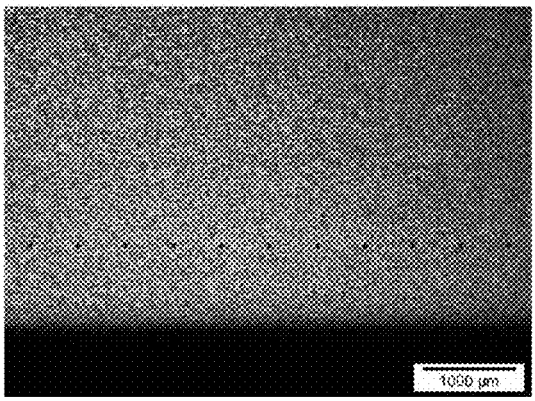

Additionally, the grain structure observed in metallography in a section perpendicular to the extrusion direction, after a Barker etching, shows the presence of a PCG layer whose thickness is approximately 1 mm with the conventional route (FIG. 8*a*) while the product according to the invention presents no PCG (FIG. 8 *b*).

Profile hardness measurement performed locally in the PCG layer of the product obtained with the conventional route exhibits a lower hardness, 9% lower than the core product. No difference is observed with the product obtained by the invention.

The invention permits thus to obtain a homogeneous structure with no PCG and no difference in hardness across the thickness while maintaining mechanical properties at a range similar to the conventional route with a separated solution heat treatment.

Example 2

A profile having an approximate rectangular section of 22 mm×32 mm (22 mm corresponds to its thickness) has been extruded by following the route according to the invention. The chemical composition is shown in Table 3. The solidus temperature for this composition is estimated at 587° C.

TABLE 3

| | Si | Fe | Cu | Mn | Mg | Cr | Zn | Ti | Zr |
|---|---|---|---|---|---|---|---|---|---|
| B | 0.8 | 0.2 | 0.7 | 0.54 | 0.8 | 0.1 | 0.013 | 0.046 | 0.14 |

The cast billet was homogenized at a temperature 550° C. during 5 hours. The process according to the invention consisted in solution heat treating homogenized cast billet, 100 seconds at a soaking temperature near 530° C. It was then cooled with a water cooling device giving a heat transfer flow of approximately 1 kW/m$^2$/° C. until billet surface temperature reached 440° C. Thirty-five seconds later, thanks to the high thermal conductivity of aluminium, the temperature is almost homogeneous in the billet and lower than 480° C. The billet was then introduced into the container of the extrusion press and extruded to obtain an approximate rectangular section of 22 mm×32 mm. The extrusion speed was controlled such that the surface exit temperature was higher than 530° C. and lower than solidus temperature. The extruded products were then quenched down to room temperature with a cooling device spraying water on the profiles exiting from the extrusion press. The profiles were then stretched 2% and aged at 170° C. during 8 h.

The mechanical properties obtained are listed in Table 4

TABLE 4

| | YS (MPa) | UTS (MPa) | Ag % | A % |
|---|---|---|---|---|
| Invention route | 418 | 447 | 6.5 | 11.4 |

Figure 9:
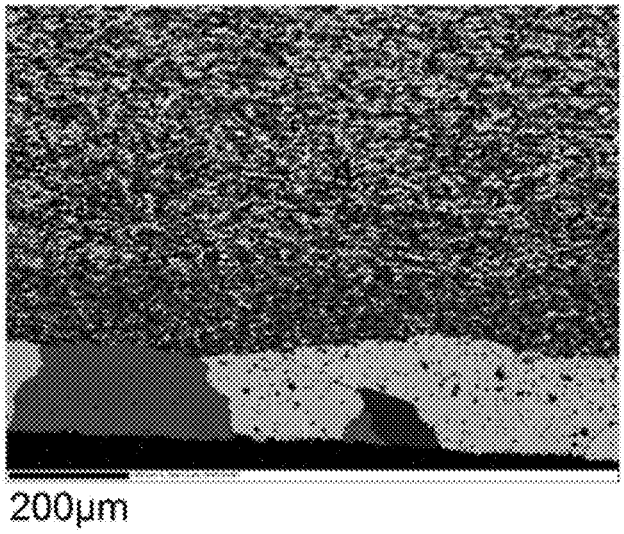
FIG. 9 represents the grain structure of a 22 mm thick extrusion, produced according to the invention, observed in EBSD. The grain structure obtained by the invention presents a PCG whose thickness is approximately in the range of 200 μm. The details of the process routes and of the EBSD characterization are described in example 2.

The grain structure observed in Electron Backscatter Diffraction (EBSD) in a section perpendicular to the extrusion direction shows the presence of a PCG layer whose thickness is approximately 200 μm (FIG. 9).

The core of the extrusion is fibrous. The crystal orientation of the core has been measured with a scanned area of 1 mm×1 mm and a step size of 5 μm.

The extruded rectangular bar presents a<111> direction on the cross section perpendicular to the extrusion direction, whose calculated area ratio is 36%. The calculation has considered a deviation of 15° from the ideal texture.

Example 3

A solid extrusion obtained by the manufacturing process according to the invention presenting an ultimate tensile strength of 452 MPa has been used to manufacture a bumper beam with a towing eye according to the invention. It was produced according to the process described in example 1. Said extrusion has an approximate rectangular section of 22 mm×32 mm (22 mm corresponds to its thickness). It has been cut at a given length of 86 mm. The diameter of the threaded hole was 26 mm.

A similar design of bumper beam (similar dimension of the extrusion used to made the towing eye, integrated into a similar hollow section to produce the bumper beam) has been made with a 6082 alloy processed according a conventional route. The extrusion product made in 6082 presented an ultimate tensile strength of 346 MPa.

A test consisting in pulling and/or pushing at different loads in different direction successively on a towing hook screwed into the towing eye permits to insure on the appropriate resistance of the towing eye. It is requisite in particular an absence of cracks into the towing eye. Load is selected in function of the weight of the car: higher the loads admissible, safer and more reliable is the towing system.

The test consists in a sequence of loading, the load is calculated according to a nominal load and varies from 50% to 110% versus this nominal load. Depending on the value of the load, the test consists in pulling or pushing the towing hook at different angles. The angle is measured according to the deviation with the longitudinal axis of the vehicle. The deviation can take place in the plane which includes the longitudinal axis of the vehicle and the horizontal, referenced as Xplane or in the plane which includes the longitudinal axis of the vehicle and the vertical, referenced as Y plane. The angle can be positive or negative depending if the load is applied in which half plane which contains the longitudinal axis. The sign is arbitrary.

According to the sequence of loading, listed in Table 5, no cracks are observed for a load of 20.1 kN for the bumper manufactured according the invention, while some cracks are observed for a load of 19.1 kN manufactured with a 6082 extrusion.

TABLE 5

| % vs Nominal | Pull/Push | Angle | Repeated x times |
|---|---|---|---|
| 70% | Pull | 0 | 50 times |
| 110 | Pull | 0 | 5 times |
| 70 | Pull | +30 Xplane | 10 times |
| 110 | Pull | +30 Xplane | 3 times |
| 70 | Pull | −30 Xplane | 10 times |
| 110 | Pull | −30 Xplane | 3 times |
| 50 | Pull | +70 Xplane | 3 times |
| 50 | Pull | −70 Xplane | 3 times |
| 70 | Pull | +20 Yplane | 10 times |
| 70 | Pull | −20° Yplane | 10 times |
| 50 | Push | 0 | 10 times |
| 50 | Push | +30° Xplane | 5 times |
| 50 | Push | −30° Xplane | 5 times |

The invention claimed is:

1. A solid extrusion with a thickness higher than 10 mm obtained by a process comprising:

a) casting a billet of an aluminum alloy comprising Si: 0.3-0.8 wt. %; Mg: 0.1-0.8 wt. %, Cu: 0.4-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % each, the rest being aluminium;

b) homogenizing said billet;

c) heating the said homogenised cast billet;

d) extruding the said billet through a die to form a solid extrusion with a thickness higher than 10 mm;

e) quenching said solid extrusion down to room temperature;

f) optionally stretching the solid extrusion to obtain a plastic deformation between 0.5% and 5%;

g) ageing the quenched and optionally stretched solid extrusion without applying any separate post-extrusion solution heat treatment; wherein said ageing treatment is a one- or multiple-step heat treatment at a temperature between 150° C. and 200° C. for a prescribed period of time, defined to obtain the maximum ultimate strength wherein:

i) the heating c) is a solution heat treatment wherein:

c1) the cast and homogenized billet is heated to a temperature between Ts-15° C. and Ts, wherein Ts is the solidus temperature of the said aluminium alloy;

c2) the billet is cooled until billet mean temperature reaches a value between 370° C. and 480° C. while ensuring billet surface never goes below a temperature of 370° C.;

ii) the cooled billet is immediately extruded (step d) after the end of c2);

iii) said aged solid extrusion presents an ultimate tensile strength higher than 400 MPa;

iv) said aged solid extrusion comprises a peripheral coarse grain (PCG) layer having a thickness lower than 0.8 mm.

2. The solid extrusion according to claim 1, wherein said cast billet is homogenized in b) at a temperature between 80° C. and 150° C. lower than solidus.

3. The solid extrusion according to claim 1, wherein a. 0.2 wt. %≤Si—(Mg/1.73)-(Fe+Mn)/3≤0.7 wt. % b. the quantity of $Mg_2Si$ is in the range of 1.2 wt. % to 1.6 wt. %.

4. The solid extrusion according to claim 1 comprising a tensile yield strength higher than 370 MPa.

5. The solid extrusion according to claim 1 comprising a thickness higher than 20 mm.

6. A towing system made of a towing eye obtained by machining a threaded hole into the solid extrusion of claim 1 to obtain a towing eye; said machining comprises cutting, drilling, turning, grinding, and/or threading, in any sequence, and a ring.

7. A bumper with a towing eye, obtained by cutting the solid extrusion of claim 1 to a given length, said length being optionally lower than 150 mm, positioning said cut solid extrusion into a hollow extrusion section with at least one chamber; said hollow section having a length higher than 1 m, fixing said solid extrusion to the hollow extrusion section, drilling and threading a hole in the part of the hollow section and in said fixed solid extrusion to create the towing eye.

8. A motor vehicle with a towing eye, wherein said towing eye is obtained by machining a threaded hole into the solid extrusion of claim 1, and wherein said machining comprises cutting, drilling, turning, grinding, and/or threading, in any sequence.

9. The solid extrusion according to claim 1 having an ultimate tensile strength higher than 430 MPa.

10. The solid extrusion according to claim 1 having an ultimate tensile strength higher than 450 MPa.

11. The solid extrusion according to claim 1 comprising a tensile yield strength higher than 400 MPa.

12. The solid extrusion according to claim 1 comprising a tensile yield strength higher than 420 MPa.

13. The solid extrusion according to claim 1, wherein said cast billet is homogenized in b) at a temperature between 540-550° C.

14. The solid extrusion according to claim 1, wherein the extrusion comprises a peripheral coarse grain (PCG) layer having a thickness lower than 0.5 mm.

15. The solid extrusion according to claim 1, wherein the extrusion comprises a peripheral coarse grain (PCG) layer having a thickness equal to or lower than 0.2 mm.

16. The solid extrusion according to claim 1, wherein the alloy consists essentially of Si: 0.3-0.8 wt. %; Mg: 0.1-0.8 wt. %, Cu: 0.4-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % each, and the rest being aluminium.

17. A manufacturing process for obtaining a solid extrusion with a thickness higher than 10 mm according to claim 1, wherein said manufacturing process comprises:

a) casting a billet of aluminum an alloy comprising Si: 0.3-0.8 wt. %; Mg: 0.1-0.8 wt. %, Cu: 0.1-0.8 wt. %, Zn 0.005-0.7 wt %, one or more dispersoid element, from the group consisting of Mn 0.15-1 wt. %, Cr 0.05-0.4 wt. % and Zr 0.05-0.25 wt. %, Fe at most 0.5 wt. %, other elements at most 0.05 wt. % each, the rest being aluminium;

b) homogenizing said billet;

c) heating the said homogenised cast billet;

d) extruding the said billet through a die to form a solid extrusion with a thickness higher than 10 mm;

e) quenching said solid extrusion down to room temperature;

f) optionally stretching the solid extrusion to obtain a plastic deformation between 0.5% and 5%;

g) ageing the quenched and optionally stretched solid extrusion without applying any separate post-extrusion solution heat treatment to obtain an aged solid extrusion; wherein said ageing treatment is a one- or multiple-step heat treatment at a temperature between 150° C. and 200° C. for a prescribed period of time, defined to obtain the maximum ultimate strength wherein:

i) the heating c) is a solution heat treatment wherein:

c1) the cast and homogenized billet is heated to a temperature between Ts-15° C. and Ts, wherein Ts is the solidus temperature of the said aluminium alloy;

c2) the billet is cooled until billet mean temperature reaches a value between 370° C. and 480° C. while ensuring billet surface never goes below a temperature of 370° C.

ii) the cooled billet is immediately extruded (step d) after the end of c2);

iii) said aged solid extrusion presents an ultimate tensile strength higher than 400 MPa.

18. A manufacturing method according to claim 17, further comprising machining a threaded hole into the resulting aged solid extrusion to obtain a towing eye; wherein said machining comprises cutting, drilling, turning, grinding, and/or threading, in any sequence.

19. A manufacturing method according to claim 17, further comprising cutting the resulting aged solid extrusion to a given length to obtain a cut solid extrusion, positioning said cut solid extrusion into a hollow extrusion section with at least one chamber; said hollow section having a length higher than 1 m and shaped to form a bumper, fixing said solid extrusion to the hollow extrusion section to obtain a fixed solid extrusion, drilling and threading a hole in a part of the hollow section and in said fixed solid extrusion to create a bumper with a towing eye.

20. The method according to claim 19, wherein said solid extrusion is fixed to the hollow extrusion section by crimping, screwing, bolting, bonding, or welding.

* * * * *